US010100386B2

(12) United States Patent
Woodfield et al.

(10) Patent No.: US 10,100,386 B2
(45) Date of Patent: *Oct. 16, 2018

(54) METHOD FOR PREPARING A METALLIC ARTICLE HAVING AN OTHER ADDITIVE CONSTITUENT, WITHOUT ANY MELTING

(75) Inventors: Andrew Philip Woodfield, Cincinnati, OH (US); Eric Allen Ott, Cincinnati, OH (US); Clifford Earl Shamblen, Cincinnati, OH (US); Michael Francis Xavier Gigliotti, Scotia, NY (US)

(73) Assignee: General Electric Company, Schenectady, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/523,941

(22) Filed: Jun. 15, 2012

(65) Prior Publication Data

US 2012/0263619 A1 Oct. 18, 2012

Related U.S. Application Data

(63) Continuation of application No. 12/187,413, filed on Aug. 7, 2008, now Pat. No. 8,216,508, which is a continuation of application No. 10/847,599, filed on May 17, 2004, now Pat. No. 7,416,697, which is a continuation-in-part of application No. 10/172,217, filed on Jun. 14, 2002, now Pat. No. 6,737,017, and a continuation-in-part of application No. 10/172,218, filed on Jun. 14, 2002, now Pat. No. 7,329,381, and a continuation-in-part of application No. 10/329,143, filed on Dec. 23, 2002, now Pat. No. 7,037,463, and a continuation-in-part of application No. 10/350,968, filed on Jan. 22, 2003, now Pat. No. 6,921,510, and a continuation-in-part of application No. 10/371,743, filed on Feb. 19, 2003, now Pat. No. 7,419,528.

(51) Int. Cl.

| | |
|---|---|
| ***B22F 1/02*** | (2006.01) |
| ***C22B 34/12*** | (2006.01) |
| ***B22F 3/00*** | (2006.01) |
| ***B22F 9/18*** | (2006.01) |
| ***B22F 9/20*** | (2006.01) |
| ***B22F 9/28*** | (2006.01) |
| ***C21B 13/00*** | (2006.01) |
| ***C21B 13/14*** | (2006.01) |
| ***C22B 5/12*** | (2006.01) |
| ***C22C 1/04*** | (2006.01) |
| ***C22C 1/10*** | (2006.01) |
| *C22B 4/06* | (2006.01) |

(52) U.S. Cl.

CPC ..... *C22B 34/1263* (2013.01); *B22F 1/02* (2013.01); *B22F 3/001* (2013.01); *B22F 9/18* (2013.01); *B22F 9/20* (2013.01); *B22F 9/28* (2013.01); *C21B 13/006* (2013.01); *C21B 13/146* (2013.01); *C22B 5/12* (2013.01); *C22B 34/129* (2013.01); *C22B 34/1295* (2013.01); *C22C 1/04* (2013.01); *C22C 1/0433* (2013.01); *C22C 1/0458* (2013.01); *C22C 1/10* (2013.01); *B22F 2998/00* (2013.01); *B22F 2999/00* (2013.01); *C22B 4/06* (2013.01); *C22C 2001/1089* (2013.01)

(58) Field of Classification Search

USPC ..... 419/38

See application file for complete search history.

(56) References Cited

U.S. PATENT DOCUMENTS

| | | | |
|---|---|---|---|
| 1,969,396 | A | 8/1934 | Franz |
| 2,100,545 | A | 11/1937 | Hiemke |
| 2,485,782 | A | 10/1949 | Schweitzer |
| 2,799,570 | A | 7/1957 | Reed et al. |
| 2,822,262 | A | 2/1958 | Lucien et al. |
| 2,828,199 | A | 3/1958 | Findlay |
| 2,833,030 | A | 5/1958 | Peaslee |

(Continued)

FOREIGN PATENT DOCUMENTS

| | | | |
|---|---|---|---|
| CA | 2331707 | A1 | 11/2000 |
| CN | 1308566 | A | 8/2001 |

(Continued)

OTHER PUBLICATIONS

Powder Metallurgy Ti-6Al-4V-xB Alloy, Journal of Medicine, May 2004, ys: Processing, Microstructure, and Properties, S. Tamirisakandala, R.B. Bhat, V.A. Ravi and D.B. Miracle, Member of Journal of the Minerals, Metals & Materials Society, May 2004.

(Continued)

*Primary Examiner* — Christopher Kessler

(74) *Attorney, Agent, or Firm* — General Electric Company; Brian P. Overbeck

(57) ABSTRACT

A method for preparing an article of a base metal alloyed with an alloying element includes the steps of preparing a compound mixture by the steps of providing a chemically reducible nonmetallic base-metal precursor compound of a base metal, providing a chemically reducible nonmetallic alloying-element precursor compound of an alloying element, and thereafter mixing the base-metal precursor compound and the alloying-element precursor compound to form a compound mixture. The compound mixture is thereafter reduced to a metallic alloy, without melting the metallic alloy. The step of preparing or the step of chemically reducing includes the step of adding an other additive constituent. The metallic alloy is thereafter consolidated to produce a consolidated metallic article, without melting the metallic alloy and without melting the consolidated metallic article.

19 Claims, 2 Drawing Sheets

(56) References Cited

U.S. PATENT DOCUMENTS 2,837,811 A 6/1958 Hatch
2,937,979 A 5/1960 Wainer
3,012,878 A 12/1961 Muller
3,019,103 A 1/1962 Alexander et al.
3,052,538 A 9/1962 Robert
3,152,389 A 10/1964 Alexander et al.
3,330,697 A 7/1967 Pechini
3,449,115 A 6/1969 Galmiche et al.
3,469,301 A 9/1969 Freyberger et al.
3,501,287 A 3/1970 Lever
3,539,307 A 11/1970 Baumel
3,622,406 A 11/1971 Vordahl
3,655,360 A 4/1972 Lindquist
3,723,109 A 3/1973 Lacock et al.
3,736,132 A 5/1973 Morse et al.
3,737,300 A 6/1973 Cairns et al.
3,754,902 A 8/1973 Goward et al.
3,773,493 A 11/1973 Brecher et al.
3,802,850 A 4/1974 Clougherty
3,814,635 A 6/1974 Cometto et al.
3,909,247 A 9/1975 Paris et al.
3,923,496 A 12/1975 Pall
3,925,114 A 12/1975 Takahashi et al.
3,992,161 A 11/1976 Cairns et al.
4,023,989 A 5/1977 Dobo
4,046,853 A 9/1977 Robinson
4,101,713 A 7/1978 Hirsch et al.
4,104,445 A 8/1978 Dobo
4,138,872 A 2/1979 Lengyel
4,253,933 A 3/1981 Sato et al.
4,282,195 A 8/1981 Hoekje
4,353,885 A 10/1982 Hoekje
4,356,029 A 10/1982 Down et al.
4,373,947 A 2/1983 Buttner et al.
4,383,852 A 5/1983 Yoshizawa
4,415,528 A 11/1983 Wiech, Jr.
4,449,115 A 5/1984 Koerner
4,512,826 A 4/1985 Whang
4,519,839 A 5/1985 Toyoaki et al.
4,525,206 A 6/1985 Soled et al.
4,534,935 A 8/1985 Ambrose et al.
4,537,625 A 8/1985 Tenhover et al.
4,552,206 A 11/1985 Johnson et al.
4,604,259 A 8/1986 Whitman
4,622,079 A 11/1986 Chang et al.
4,624,706 A 11/1986 Badia
4,632,702 A 12/1986 Digiambattista
4,659,288 A 4/1987 Clark et al.
4,687,632 A 8/1987 Hurd et al.
4,714,587 A 12/1987 Eylon et al.
4,725,312 A 2/1988 Seon et al.
4,731,111 A 3/1988 Kopatz et al.
4,752,334 A 6/1988 Nadkarni et al.
4,799,975 A 1/1989 Ouchi et al.
4,820,339 A 4/1989 Bienvenu et al.
4,844,746 A 7/1989 Hoermann et al.
4,851,053 A 7/1989 Froes et al.
4,894,086 A 1/1990 Huether et al.
4,906,430 A 3/1990 Abkowitz et al.
4,906,436 A 3/1990 Gigliotti, Jr. et al.
4,915,905 A 4/1990 Kampe et al.
4,916,107 A 4/1990 Brand et al.
4,940,572 A 7/1990 Laundon et al.
4,999,336 A 3/1991 Nadkarni et al.
5,000,910 A 3/1991 Tokizane et al.
5,026,520 A 6/1991 Bhowal et al.
5,032,176 A 7/1991 Kametani et al.
5,041,262 A 8/1991 Gigliotti, Jr.
5,100,050 A 3/1992 Krueger et al.
5,176,741 A 1/1993 Bartlett et al.
5,196,181 A 3/1993 Hartmann
5,256,479 A 10/1993 Tokuoka et al.
5,312,650 A 5/1994 Dalal et al.
5,322,666 A 6/1994 Watwe
5,324,341 A 6/1994 Nagel et al.
5,328,501 A 7/1994 McCormick et al.
5,360,961 A 11/1994 Ingall et al.
5,373,529 A 12/1994 Zanner et al.
5,409,518 A 4/1995 Saito et al.
5,421,917 A 6/1995 Partridge et al.
5,431,874 A 7/1995 Gigliotti, Jr.
5,460,642 A 10/1995 Leland
5,462,686 A 10/1995 Sugiyama et al.
5,468,457 A 11/1995 Dorfman et al.
5,470,549 A 11/1995 Dorfman et al.
5,498,446 A 3/1996 Axelbaum et al.
5,505,902 A 4/1996 Fischer et al.
5,541,006 A 7/1996 Conley
5,572,124 A 11/1996 Bito et al.
5,599,519 A 2/1997 Haddow
5,686,676 A 11/1997 Jech et al.
5,709,783 A 1/1998 Sanchez et al.
5,713,982 A 2/1998 Clark et al.
5,759,230 A 6/1998 Chow et al.
5,772,724 A 6/1998 Inoue et al.
5,779,761 A 7/1998 Armstrong et al.
5,830,288 A 11/1998 Gigliotti, Jr. et al.
5,849,652 A 12/1998 Davies et al.
5,865,980 A 2/1999 Ray et al.
5,897,801 A 4/1999 Smashey et al.
5,911,102 A 6/1999 Takahashi et al.
5,930,580 A 7/1999 Everett
5,958,106 A 9/1999 Armstrong et al.
5,980,655 A 11/1999 Kosaka
5,989,493 A 11/1999 La Salle et al.
6,001,495 A 12/1999 Bristow et al.
6,019,812 A 2/2000 Volas et al.
6,036,742 A 3/2000 Leutner et al.
6,099,664 A 8/2000 Davies et al.
6,117,204 A 9/2000 Saito et al.
6,117,208 A 9/2000 Sharma
6,136,265 A 10/2000 Gay
6,152,982 A 11/2000 Froes et al.
6,171,989 B1 1/2001 Yoshida
6,179,899 B1 1/2001 Higa et al.
6,218,026 B1 4/2001 Ewing et al.
6,231,636 B1 5/2001 Froes et al.
6,251,159 B1 6/2001 Angeliu et al.
6,264,719 B1 7/2001 Zhang et al.
6,302,649 B1 10/2001 Mukira et al.
6,333,072 B1 12/2001 Lane et al.
6,334,908 B1 1/2002 Kawano et al.
6,344,271 B1 2/2002 Yadav et al.
6,376,103 B1 4/2002 Sampath et al.
6,393,690 B1 5/2002 Snitchler et al.
6,406,532 B1 6/2002 Hartmann et al.
6,409,794 B2 6/2002 Wolmer et al.
6,409,797 B2 6/2002 Armstrong et al.
6,410,160 B1 6/2002 Landin et al.
6,433,547 B2 8/2002 Kabasawa et al.
6,454,882 B1 9/2002 Martin
6,464,750 B1 10/2002 Tailhades et al.
6,482,387 B1 11/2002 Guelguen et al.
6,485,584 B1 11/2002 Lambard et al.
6,521,173 B2 2/2003 Kumar et al.
6,530,972 B2 3/2003 Akimoto et al.
6,540,811 B2 4/2003 Hosoe et al.
6,540,843 B1 4/2003 Liu et al.
6,551,371 B1 4/2003 Furuta et al.
6,561,259 B2 5/2003 Spadafora et al.
6,569,270 B2 5/2003 Segal
6,582,651 B1 6/2003 Cochran, Jr. et al.
6,582,851 B2 6/2003 Cheiky et al.
6,635,098 B2 10/2003 Abkowitz et al.
6,638,098 B2 10/2003 Abkowitz et al.
6,663,763 B2 12/2003 Strezov et al.
6,719,821 B2 4/2004 Yadav et al.
6,737,012 B2 5/2004 Nakano et al.
6,737,017 B2 5/2004 Woodfield et al.
6,843,229 B2 1/2005 Bauerle et al.
6,849,229 B2 2/2005 Ott et al.
6,884,279 B2 4/2005 Woodfield et al.
6,887,296 B2 5/2005 Mende et al.
6,921,510 B2 7/2005 Ott et al.

(56) References Cited

U.S. PATENT DOCUMENTS

| | | | |
|---|---|---|---|
| 6,926,754 | B2 | 8/2005 | Shamblen et al. |
| 6,926,755 | B2 | 8/2005 | Shamblen et al. |
| 6,958,115 | B2 | 10/2005 | O'Gardy et al. |
| 6,968,900 | B2 | 11/2005 | Williams et al. |
| 6,968,990 | B2 | 11/2005 | Ott et al. |
| 7,001,443 | B2 | 2/2006 | Woodfield et al. |
| 7,013,949 | B2 | 3/2006 | Cervantes et al. |
| 7,037,463 | B2 | 5/2006 | Woodfield et al. |
| 7,329,381 | B2 | 2/2008 | Woodfield et al. |
| 7,384,596 | B2 | 6/2008 | Woodfield et al. |
| 7,410,610 | B2 | 8/2008 | Woodfield et al. |
| 7,510,680 | B2 | 3/2009 | Steibel et al. |
| 7,531,021 | B2 | 5/2009 | Woodfield et al. |
| 7,553,383 | B2 | 6/2009 | Shamblen et al. |
| 7,604,680 | B2 | 10/2009 | Shamblen et al. |
| 7,833,472 | B2 | 11/2010 | Ott et al. |
| 7,842,231 | B2 | 11/2010 | Woodfield et al. |
| 7,897,103 | B2 | 3/2011 | Ott et al. |
| 2002/0015889 | A1 | 2/2002 | Yamamoto et al. |
| 2002/0025272 | A1 | 2/2002 | Witherspoon et al. |
| 2002/0068005 | A1 | 6/2002 | Meinhardt et al. |
| 2002/0073804 | A1 | 6/2002 | Meiss |
| 2002/0136658 | A1 | 9/2002 | Dilmore et al. |
| 2002/0184971 | A1 | 12/2002 | Myrick |
| 2003/0025108 | A1 | 2/2003 | Seroldi |
| 2003/0117691 | A1 | 6/2003 | Bi et al. |
| 2003/0205108 | A1 | 11/2003 | Lee et al. |
| 2003/0230170 | A1 | 12/2003 | Woodfield et al. |
| 2003/0231974 | A1 | 12/2003 | Woodfield et al. |
| 2004/0050208 | A1 | 3/2004 | Nie et al. |
| 2004/0055419 | A1 | 3/2004 | Kurihara et al. |
| 2004/0084323 | A1 | 5/2004 | Strezov et al. |
| 2004/0096350 | A1 | 5/2004 | Moxson et al. |
| 2004/0123700 | A1 | 7/2004 | Zhou et al. |
| 2004/0141869 | A1 | 7/2004 | Ott et al. |
| 2004/0159185 | A1 | 8/2004 | Shamblen et al. |
| 2004/0205108 | A1 | 10/2004 | Tanaka |
| 2005/0220656 | A1 | 10/2005 | Shamblen et al. |

FOREIGN PATENT DOCUMENTS

| | | | |
|---|---|---|---|
| CN | 1699000 | B | 9/2011 |
| DE | 1005942 | B | 4/1957 |
| DE | 1129710 | A1 | 5/1962 |
| EP | 0255616 | A1 | 2/1988 |
| EP | 0444577 | A2 | 9/1991 |
| EP | 0577116 | A1 | 1/1994 |
| EP | 0728223 | B1 | 11/1994 |
| EP | 0751228 | A1 | 1/1997 |
| EP | 1018386 | A1 | 6/1999 |
| EP | 0997544 | A1 | 5/2000 |
| EP | 1186680 | A2 | 3/2002 |
| EP | 1486875 | A1 | 6/2003 |
| EP | 1433555 | A1 | 12/2003 |
| EP | 1488874 | A1 | 6/2004 |
| EP | 1445350 | A1 | 8/2004 |
| EP | 1486575 | A1 | 12/2004 |
| GB | 500504 | A | 2/1939 |
| GB | 756497 | A | 9/1956 |
| GB | 883429 | A | 11/1961 |
| GB | 1092034 | A | 11/1967 |
| JP | 4851892 | U | 7/1973 |
| JP | 57164958 | A | 10/1982 |
| JP | 57171603 | A | 10/1982 |
| JP | 59107904 | A | 6/1984 |
| JP | 6191347 | A | 5/1986 |
| JP | 63427 | A | 1/1988 |
| JP | 01184203 | A | 7/1989 |
| JP | 01184239 | A | 7/1989 |
| JP | 01294810 | A | 11/1989 |
| JP | 02155729 | A | 6/1990 |
| JP | 04501137 | A | 2/1992 |
| JP | 0578762 | A | 3/1993 |
| JP | 05171214 | A | 7/1993 |
| JP | 0625774 | A | 2/1994 |
| JP | 08503023 | A | 4/1996 |
| JP | 08157990 | A | 6/1996 |
| JP | 08311586 | A | 11/1996 |
| JP | 09227972 | A | 9/1997 |
| JP | 11080815 | A1 | 3/1999 |
| JP | 1192843 | A | 4/1999 |
| JP | 11291087 | A | 10/1999 |
| JP | 2002003977 | A | 1/2002 |
| JP | 1295955 | A1 | 3/2003 |
| JP | 2004512959 | A | 4/2004 |
| JP | 2005533660 | A | 11/2005 |
| JP | 6005142 | B2 | 8/2012 |
| JP | 5025085 | B2 | 9/2012 |
| RU | 2148094 | C1 | 4/2000 |
| RU | 2152449 | C1 | 7/2000 |
| RU | 2215381 | C1 | 10/2003 |
| SU | 411962 | A1 | 1/1974 |
| SU | 1243612 | A3 | 7/1986 |
| SU | 1748542 | | 3/1995 |
| SU | 1826300 | | 3/1996 |
| SU | 1582683 | A1 | 9/1996 |
| SU | 1753729 | | 10/1996 |
| WO | 9401361 | A1 | 1/1994 |
| WO | 9410351 | A | 5/1994 |
| WO | 98/43763 | | 10/1998 |
| WO | 9915293 | A1 | 4/1999 |
| WO | 9964638 | A1 | 12/1999 |
| WO | 0008220 | A1 | 2/2000 |
| WO | 0076698 | A1 | 12/2000 |
| WO | 200076668 | A1 | 12/2000 |
| WO | 0145906 | A2 | 6/2001 |
| WO | 0162996 | A1 | 8/2001 |
| WO | 2001062995 | A1 | 8/2001 |
| WO | 2002040725 | A2 | 5/2002 |
| WO | 02061168 | A2 | 8/2002 |
| WO | 02085532 | A1 | 10/2002 |
| WO | 2003003785 | A1 | 1/2003 |
| WO | 2003016594 | A1 | 2/2003 |
| WO | 03049889 | A2 | 6/2003 |
| WO | 2004011685 | A1 | 2/2004 |

OTHER PUBLICATIONS

Cerme Ti Discontinuously Reinforced Ti-Matrix Composites: Manufacturing, Properties, and Applications, Stanley Abkowitz, Susan M. Abkowitz, Harvey Fisher and Patricia J. Schwartz, Member of Journal of the Minerals, Metals & Materials Society, May 2004.

High-Temperature Deformation Behavior of Ti-TiB in-Situ Metal-Matrix Composites, Sweety Kumari, N. Eswara Prasad, K.S. Ravi Chandran, and G. Malakondaiah, Member of Journal of the Minerals, Metals & Materials Society, May 2004.

The Prospects for Hybrid Fiber-Reinforced Ti-TiB—Matrix Composites, W. Hanusiak, C.F. Yolton, J. Fields, V. Hammong, and R. Grabow, Member of Journal of the Minerals, Metals & Materials Society, May 2004.

TiB—Reinforced TiB Composites: Processing, Properties, Application Properties and Research Needs, K.S. Ravi Chandran, K. B.I :Panda and S.S. Sahay, Member of Journal of the Minerals, Metals & Materials Society, May 2004.

Titanium-Boron Alloys and Composites: Processing, Properties, and Applications, K.S. Ravi Chandran and Daniel B. Miracle, Member of Journal of the Minerals, Metals & Materials Society, May 2004.

The Pre-Alloyed Powder Metallurgy of Titanium with Boron and Carbon Additions, C.F. Yolton, Member of Journal of the Minerals, Metals & Materials Society, May 2004.

The Automotive Application of Discontinuously Reinforced TiB-Ti Composites, Takashi Saito, Member of Journal of the Minerals, Metals & Materials Society, May 2004.

Gerdemann et al., Characterization of a Titanium Powder Produced Through a Novel Continuous Process, U.S. Department of Energy, Albany Research Center, Albany, Oregon, pp. 12-44 through 12-52, USA.

Moxson et al., Production, Characterization and Applications of Low Cost Titanium Powder Products, the Minerals, Metals & Materials Society, 1998, pp. 127-134, USA.

(56) References Cited

OTHER PUBLICATIONS

Baburaj et al., Production of Low Cost Titanium, The Minerals, Metals & Materials Society, 1998, pp. 89-97, USA.
Gerdemann, Steven J., Titanium Process Technologies, Advanced Materials & Processes, Jul. 2001, pp. 41-43, USA.
Doyle, Eoghan T.M. et al. "Carbothermic reduction of nickel-cobalt-chromium oxide mixture for the production of NiCoCr superalloy powder" EPD Congr. 1992, Proc. Symp. TMS Annu. Meet., 745-58. Editor(s): Hager, John P.; Publisher: Miner. Met. Mater. Soc., Warrendale, PA. Coden: 58HHA7, 1992, XP0009029023.
Matthew J. Donachie, Jr.: "Titanium (A Technical Guide"), ASM International, USA XP 002253129, p. 47-p. 51.
CN Office Action dated Mar. 5, 2013 from corresponding CN Application No. 201110203405.1.
Sohn "Ti and TiAL Powders by the Flash Reduction of Chloride Vapors", JOM, Springer New York LLC, US, vol. 50, No. 9, Sep. 1998, pp. 50-51.
Unofficial translation of Ystinov, V.S., et al. "Powder Metallurgy of Titanium", Metallurgy Publishers, 1981, p. 17.
Unofficial translation of Chinese Office Action and Search Report from CN Patent Application No. 201410028127.4 dated Apr. 30, 2015.
EP Search Report and Written Opinion from EP Patent Application No. 10183269.9 dated Dec. 8, 2010.
European Search Report and Written Opinion from EP Patent Application No. 10184505.5 dated Dec. 14, 2010.
ASM International, Materials Park, Ohio, Properties and Selection: Nonferrous Alloys and Special Purpose Materials: "Rare Earth Metals", Oct. 1990, vol. 2, pp. 720-732.
ASM International, Materials Park, Ohio, Properties and Selection: Nonferrous Alloys and Special Purpose Materials: "Introduction to Titanium and Titanium Alloys", Oct. 1990, vol. 2, pp. 586-591.
Hedrick, J.B., "Rare earth metals", In: Minerals Yearbook 1996. US Department of the Interior, Geological Survey, Reston. pp. 61.1-61.6, 1997.
Darab, J.G. et al. "Characterization and processing of Sintered Products from Nan-Crystalline Powders Generated by the RTDS Method", Aug. 1993, 24th Annual Meeting of Fine Particle Society,Chicago, IL, US, 16 pages.
European Search Report and Written Opinion from EP Patent Application No. 09165463.2 dated Oct. 5, 2009.
Ystinov et al., "Powder Metallurgy of Titanium", Moscow, The Metallurgy Publishers, pp. 17, 1981.
Swedish, "Academy of Sciences Institute of Ukrainian SSR Material", Glossary of Metallurgy, Kiev, pp. 51, 1982.
Davis et al., "Properties and Selection: Nonferrous Alloys and Special Purpose Materials:, Rare Earth Metals", ASM Handbook, vol. No. 2, pp. 720-732, Oct. 1990.
Davis et al., "Properties and Selection: Nonferrous Alloys and Special Purpose Materials", Introduction to Titanium and Titanium Alloys, ASM Handbook, vol. No. 2, pp. 586-591, Oct. 1990.
Sohn, "Ti and Tial Powders by the Flash Reduction of Chloride Vapors", vol. No. 50, Issue No. 9, pp. 50-51, Sep. 1, 1998.
Sanderow, "Powder Metallurgy Methods and Design", ASM Handbook, Powder Metal Technologies and Applications, vol. No. 7, pp. 9-15, 1998.
European Search Report and Written Opinion issued in connection with corresponding EP Application No. 03258048.2-2122 dated Apr. 3, 2006.
European Search Report and Written Opinion issued in connection with corresponding EP Application No. 04250314.4-2122 dated Apr. 3, 2006.
Office Action issued in connection with corresponding RU Application No. 2005100773/02 dated May 14, 2007.
Office Action issued in connection with corresponding EP Application No. 03258048.2-2122 dated Aug. 28, 2007.
Office Action issued in connection with corresponding RU Application No. 2005100773/02 dated Jan. 25, 2008.
Office Action issued in connection with corresponding RU Application 2005100773/02 No. dated May 5, 2009.
Unofficial English translation of Office Action issued in connection with corresponding CN Application No. 200510075896.0 dated Jul. 10, 2009.
European Search Report and Written Opinion issued in connection with corresponding EP Application No. 10183264.0-2122 dated Dec. 8, 2010.
Office Action issued in connection with corresponding CA Application No. 2,506,391 dated Mar. 1, 2012.
Unofficial English translation of Notice of Allowance issued in connection with corresponding JP Application No. 2004-512959 dated May 22, 2012.
Office Action issued in connection with corresponding EP Application No. 04250314.4-2122 dated Sep. 11, 2012.
Office Action issued in connection with corresponding EP Application No. 09165463.2-1362 dated May 27, 2013.
Office Action issued in connection with corresponding CA Application No. 2,488,993 dated Jul. 30, 2013.
Unofficial English translation of Office Action issued in connection with corresponding JP Application No. 2012-049880 dated Jul. 30, 2013.
Unofficial English translation of Notice of Allowance issued in connection with corresponding JP Application No. 2005-142470 dated Aug. 13, 2013.
Unofficial English translation of Office Action issued in connection with corresponding JP Application No. 2013-146084 dated Aug. 12, 2014.
Unofficial English translation of Office Action issued in connection with corresponding CN Application No. 201410028127.4 dated Apr. 30, 2015.
Non-Final Rejection towards corresponding U.S. Appl. No. 10/172,217 dated Jul. 3, 2003.
Non-Final Rejection towards corresponding U.S. Appl. No. 10/172,218 dated Jul. 7, 2003.
Notice of Allowance towards corresponding U.S. Appl. No. 10/116,479 dated Sep. 17, 2003.
Non-Final Rejection towards corresponding U.S. Appl. No. 10/329,143 dated Oct. 7, 2004.
Final Rejection towards corresponding U.S. Appl. No. 10/847,599 dated Sep. 24, 2007.
Final Rejection towards corresponding U.S. Appl. No. 10/847,599 dated Jan. 10, 2008.
Non-Final Rejection towards corresponding U.S. Appl. No. 11/351,226 dated Apr. 30, 2008.
Final Rejection towards corresponding U.S. Appl. No. 11/351,226 dated Nov. 7, 2008.
Non-Final Rejection towards corresponding U.S. Appl. No. 11/834,171 dated Nov. 12, 2008.
Non-Final Rejection towards corresponding U.S. Appl. No. 11/351,226 dated Mar. 20, 2009.
Final Rejection towards corresponding U.S. Appl. No. 11/351,226 dated Oct. 27, 2009.
Non-Final Rejection towards corresponding U.S. Appl. No. 12/834,046 dated Sep. 22, 2010.
Non-Final Rejection towards corresponding U.S. Appl. No. 12/834,046 dated Jan. 21, 2011.
Non-Final Rejection towards corresponding U.S. Appl. No. 12/187,413 dated Jun. 21, 2011.
Clifford Earl Shamblen et al., Feb. 19, 2003, U.S. Appl. No. 10/371,743.
Andrew Philip Woodfield et al., Jun. 14, 2002, U.S. Appl. No. 10/172,218.
Andrew Philip Woodfield et al., Jun. 14, 2002, U.S. Appl. No. 10/172,217.
Andrew Philip Woodfield et al., Dec. 23, 2002, U.S. Appl. No. 10/329,143.
Eric Allen Ott et al., Jan. 22, 2003, U.S. Appl. No. 10/350,968.
Andrew Philip Woodfield et al., Nov. 12, 2004, U.S. Appl. No. 10/987,887.
Andrew Philip Woodfield et al., Jul. 25, 2013, U.S. Appl. No. 13/950,883.
Thompson et al., "In-situ-reinforced titanium matrix composites", Materials Science and Engineering, A144, pp. 121-126, 1991.

(56) References Cited

OTHER PUBLICATIONS

Panda et al., "Titanium-Titanium boride(Ti-TiB) functionally graded materials through reaction sintering: synthesis, microstructure and properties", Metallurgical and Materials Transactions, vol. 34A, 1993.
Philliber et al., "Flow and Creep Behavior of Ti/TiB In-situ Composites", Titanium' 95 Science and Technology, pp. 2715-2721, 1995.
Banerjee et al., "Comparison of Microstructural Evolution in Laser-Deposited and Arc-Melted In-Situ Ti-TiB Composites", Metallurgical and Materials Transactions, vol. 35A, 2004.
Hull et al., "Introduction to Disclocations", Department of Metallurgy and Materials Science, 2004.
European Search Report and Opinion issued in connection with corresponding EP Application No. 05256876.3 dated Feb. 6, 2006.
European Search Report and Opinion issued in connection with corresponding EP Application No. 05256818.5 dated Mar. 15, 2006.
European Office Action issued in connection with corresponding EP Application No. 05256818.5 dated Dec. 15, 2006.
US Non-Final Office Action issued in connection with corresponding U.S. Appl. No. 10/847,599 dated Apr. 6, 2007.
US Non-Final Office Action issued in connection with corresponding U.S. Appl. No. 10/987,887 dated Jun. 4, 2007.
US Non-Final Office Action issued in connection with corresponding U.S. Appl. No. 11/140,662 dated Jun. 28, 2007.
Unofficial English Translation of Chinese Office Action issued in connection with corresponding CN Application No. 200510131567.3 dated May 9, 2008.
European Office Action issued in connection with corresponding EP Application No. 05256818.5 dated Jun. 25, 2008.
European Office Action issued in connection with corresponding EP Application No. 05256818.5 dated Mar. 16, 2009.
Unofficial English Translation of Russian Office Action issued in connection with corresponding RU Application No. 2005135119 dated Nov. 23, 2009.
European Search Report and Opinion issued in connection with corresponding EP Application No. 10184522.0 dated Jan. 13, 2011.
US Non-Final Office Action issued in connection with corresponding U.S. Appl. No. 12/417,021 dated Jun. 21, 2011.
US Final Office Action issued in connection with corresponding U.S. Appl. No. 12/417,021 dated Nov. 14, 2011.
Unofficial English Translation of Japanese Office Action issued in connection with corresponding JP Application No. 2005-321931 dated Jun. 13, 2012.
US Non-Final Office Action issued in connection with corresponding U.S. Appl. No. 12/417,021 dated Jul. 2, 2012.
US Final Office Action issued in connection with corresponding U.S. Appl. No. 12/417,021 dated Nov. 9, 2012.
Unofficial English Translation of Japanese Notice of Allowance issued in connection with corresponding JP Application No. 2005318002 dated Mar. 12, 2013.
Unofficial English Translation of Japanese Office Action issued in connection with corresponding JP Application No. 2005-321931 dated Jul. 2, 2013.
European Office Action issued in connection with corresponding EP Application No. 05256818.5 dated Sep. 9, 2013.
European Office Action issued in connection with corresponding EP Application No. 10184522.0 dated Dec. 15, 2014.
Unofficial English Translation of Japanese Office Action issued in connection with corresponding JP Application No. 2013-228914 dated Nov. 4, 2015.
US Notice of Allowance issued in connection with related U.S. Appl. No. 10/329,140 dated Mar. 24, 2010.
Russian Office Action issued in connection with related RU Application No. 2006118202 dated May 25, 2010.
US Non-Final Office Action issued in connection with related U.S. Appl. No. 11/140,636 dated Jun. 10, 2010.
Russian Decision on Grant issued in connection with related RU Application No. 2006118202 dated Feb. 16, 2011.
US Non-Final Office Action issued in connection with related U.S. Appl. No. 12/135,338 dated Feb. 23, 2011.
US Final Office Action issued in connection with related U.S. Appl. No. 12/135,338 dated Aug. 2, 2011.
US Non-Final Office Action issued in connection with related U.S. Appl. No. 12/135,338 dated Jun. 14, 2013.
US Final Office Action issued in connection with related U.S. Appl. No. 12/135,338 dated Nov. 12, 2013.
European Search Report & Opinion issued in connection with related EP Application No. 10183474.5 dated Nov. 22, 2013.
European Search Report & Opinion issued in connection with related EP Application No. 10183757.3 dated Nov. 25, 2013.
Russian Office Action issued in connection with related RU Application No. 2011121700 dated Apr. 29, 2015.
Unofficial English Translation of Chinese Office Action issued in connection with related CN Application No. 201410028127.4 dated Mar. 9, 2016.
Saito et al., "Sintering Behavior and Thermal Stability of a TiB Particle Reinforced PM Beta-Titanium Matrix Composite", Titanium '95: Science and Technology, pp. 2763-2770, 1995.
"Metals Handbook", Properties and Selection of Metals, American society for metals, Definitions Relating to Metals and Metalworking, vol. No. 1, 1961.
Merriam Company, "Webster's Seventh New Collegiate Dictionary", Webster's Third New International Dictionary, Definition of "Oxidize", pp. 603, 1965.
Julius Grant, "Hackh's Chemical Dictionary", Fourth Edition, pp. 480-481, 1969.
ASM Handbook, "powder metallurgy", definition of "sintering", vol. No. 7, pp. 11, 1984.
Pandian et al., "Th-W (Thorium-Tungsten)", Binary Alloy Phase Diagrams, pp. 3485, 1987.
Davis, "ASM Materials Engineering dictionary", Definition of Alligatoring, Alloy, 1992.
Delo et al., "Early Stage Consolidation Mechanisms During Hot Isostatic Pressing of Ti-6Al-4v Powder Compacts", Department of Materials Science and Engineering, vol. No. 47, Issue No. 9, pp. 2841-2852, 1999.
European Search Report issued in connection with related EP Application No. 04250309.4 dated Mar. 24, 2004.
US Non-Final Office Action issued in connection with related U.S. Appl. No. 10/329,176 dated Mar. 24, 2004.
US Non-Final Office Action issued in connection with related U.S. Appl. No. 10/329,141 dated Apr. 9, 2004.
European Search Report issued in connection with related EP Application No. 03258071.4 dated Sep. 28, 2004.
European Search Report issued in connection with related EP Application No. 03257754.6 dated Sep. 28, 2004.
US Notice of Allowance issued in connection with related U.S. Appl. No. 10/329,141 dated Oct. 13, 2004.
US Non-Final Office Action issued in connection with related U.S. Appl. No. 10/318,763 dated Oct. 18, 2004.
European Search Report issued in connection with related EP Application No. 04253495.8 dated Oct. 27, 2004.
US Non-Final Office Action issued in connection with related U.S. Appl. No. 10/459,747 dated Dec. 1, 2004.
US Notice of Allowance issued in connection with related U.S. Appl. No. 10/350,668 dated Jan. 25, 2005.
European Office Action issued in connection with related EP Application No. 04250309.4 dated Feb. 25, 2005.
US Non-Final Office Action issued in connection with related U.S. Appl. No. 10/318,763 dated May 12, 2005.
US Non-Final Office Action issued in connection with related U.S. Appl. No. 10/318,763 dated Aug. 1, 2005.
US Non-Final Office Action issued in connection with related U.S. Appl. No. 10/329,140 dated Dec. 21, 2005.
US Non-Final Office Action issued in connection with related U.S. Appl. No. 10/318,763 dated Jan. 31, 2006.
European Office Action issued in connection with related EP Application No. 04250309.4 dated Apr. 13, 2006.
US Final Office Action issued in connection with related U.S. Appl. No. 10/329,140 dated May 18, 2006.

(56) References Cited

OTHER PUBLICATIONS

US Non-Final Office Action issued in connection with related U.S. Appl. No. 10/318,763 dated Jul. 6, 2006.
European Search Report & Opinion issued in connection with related EP Application No. 05254295.8 dated Jul. 13, 2006.
US Final Office Action issued in connection with related U.S. Appl. No. 10/318,763 dated Oct. 12, 2006.
Sewell, "Gas Tungsten Arc Welding Electrodes in Review", Engineering talk, pp. 1-7, Nov. 8, 2006.
US Non-Final Office Action issued in connection with related U.S. Appl. No. 10/896,702 dated Nov. 27, 2006.
US Final Office Action issued in connection with related U.S. Appl. No. 10/329,140 dated Dec. 15, 2006.
US Non-Final Office Action issued in connection with related U.S. Appl. No. 11/140,636 dated Feb. 5, 2007.
US Final Office Action issued in connection with related U.S. Appl. No. 10/896,702 dated Apr. 20, 2007.
US Final Office Action issued in connection with related U.S. Appl. No. 10/329,140 dated Jun. 29, 2007.
US Final Office Action issued in connection with related U.S. Appl. No. 11/140,636 dated Jul. 18, 2007.
US Examiner's Answer to Appeal Brief issued in connection with related U.S. Appl. No. 10/318,763 dated Sep. 14, 2007.
European Search Report & Opinion issued in connection with related EP Application No. 06252717.1 dated Sep. 17, 2007.
US Non-Final Office Action issued in connection with related U.S. Appl. No. 10/329,140 dated Oct. 12, 2007.
US Non-Final Office Action issued in connection with related U.S. Appl. No. 11/140,636 dated Jan. 17, 2008.
European Office Action issued in connection with related EP Application No. 06252717.1 dated May 21, 2008.
US Final Office Action issued in connection with related U.S. Appl. No. 11/140,636 dated Jun. 16, 2008.
US Final Office Action issued in connection with related U.S. Appl. No. 10/329,140 dated Jun. 17, 2008.
US Patent Board Decision Examiner Reversed issued in connection with related U.S. Appl. No. 10/318,763 dated Aug. 15, 2008.
US Non-Final Office Action issued in connection with related U.S. Appl. No. 11/140,636 dated Jan. 5, 2009.
US Non-Final Office Action issued in connection with related U.S. Appl. No. 10/329,140 dated Jan. 28, 2009.
US Final Office Action issued in connection with related U.S. Appl. No. 11/140,636 dated May 20, 2009.
US Final Office Action issued in connection with related U.S. Appl. No. 10/329,140 dated Aug. 21, 2009.
European Office Action issued in connection with related EP Application No. 04250309.4 dated Oct. 7, 2009.
European Office Action issued in connection with related EP Application No. 03258049.0 dated Oct. 8, 2009.
US Non-Final Office Action issued in connection with related U.S. Appl. No. 11/140,636 dated Nov. 6, 2009.

FIG. 1
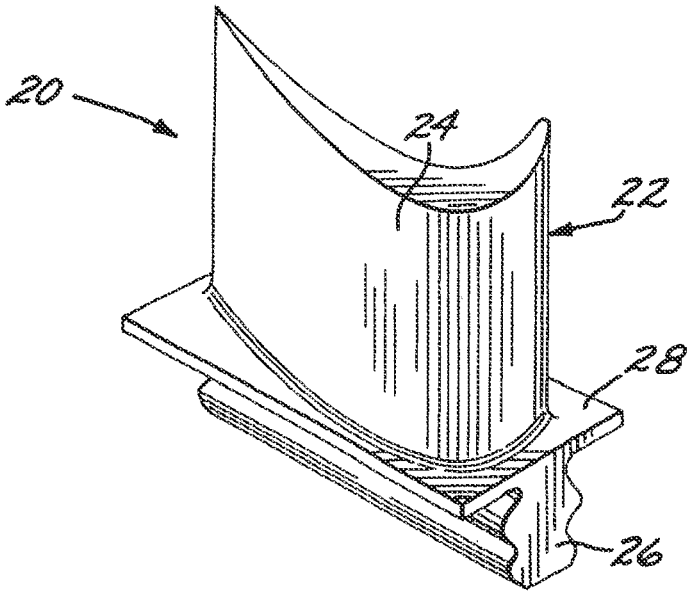
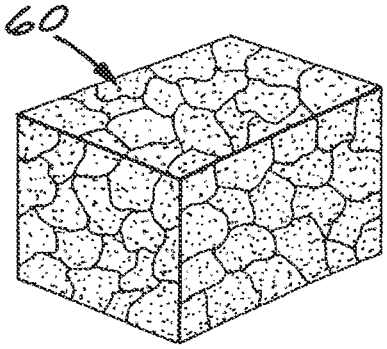
FIG. 3

METHOD FOR PREPARING A METALLIC ARTICLE HAVING AN OTHER ADDITIVE CONSTITUENT, WITHOUT ANY MELTING

This application is a continuation of application Ser. No. 12/187,413, filed Aug. 7, 2008, now U.S. Pat. No. 8,216,508, which is a continuation of Ser. No. 10/847,599, filed May 17, 2004, now U.S. Pat. No. 7,416,697, for which priority is claimed and whose disclosures are incorporated by reference. Ser. No. 10/847,599 is itself a continuation in part of application Ser. No. 10/172,217, filed Jun. 14, 2002, now U.S. Pat. No. 6,737,017 for which priority is claimed and whose disclosure is incorporated by reference; a continuation in part of application Ser. No. 10/172,218, filed Jun. 14, 2002, now U.S. Pat. No. 7,329,381 for which priority is claimed and whose disclosure is incorporated by reference; a continuation in part of application Ser. No. 10/329,143, filed Dec. 23, 2002, now U.S. Pat. No. 7,037,463 for which priority is claimed and whose disclosure is incorporated by reference; a continuation in part of application Ser. No. 10/350,968, filed Jan. 22, 2003, now U.S. Pat. No. 6,921,510 for which priority is claimed and whose disclosure is incorporated by reference; and a continuation in part of application Ser. No. 10/371,743, filed Feb. 19, 2003, now U.S. Pat. No. 7,419,528 for which priority is claimed and whose disclosure is incorporated by reference.

This invention relates to the preparation of metallic-alloy articles having an other additive constituent, without melting of the metallic alloy.

BACKGROUND OF THE INVENTION

Metallic-alloy articles are prepared by any of a number of techniques, as may be appropriate for the nature of the article. In one common approach, metal-containing ores are refined to produce a molten metal, which is thereafter cast. The ores of the metals are refined as necessary to remove or reduce the amounts of undesirable minor elements. The composition of the refined metal may also be modified by the addition of desirable alloying elements. These refining and alloying steps may be performed during the initial melting process or after solidification and remelting. After a metal of the desired composition is produced, it may be used in the as-cast form for some alloy compositions (i.e., cast alloys), or mechanically worked to form the metal to the desired shape for other alloy compositions (i.e., wrought alloys). In either case, further processing such as heat treating, machining, surface coating, and the like may be utilized.

As applications of the metallic articles have become more demanding and as metallurgical knowledge of the interrelations between composition, structure, processing, and performance has improved, many modifications have been incorporated into the basic fabrication processing. As each performance limitation is overcome with improved processing, further performance limitations become evident and must be addressed. In some instances, performance limitations may be readily overcome, and in other instances the ability to overcome the limitations is hampered by fundamental physical laws associated with the fabrication processing and the inherent properties of the metals. Each potential modification to the processing technology and its resulting performance improvement is weighed against the cost of the processing change, to determine whether it is economically acceptable.

Incremental performance improvements resulting from processing modifications are still possible in a number of areas. However, the present inventors have recognized in the work leading to the present invention that in other instances the basic fabrication approach imposes fundamental performance limitations that cannot be overcome at any reasonable cost. They have recognized a need for a departure from the conventional thinking in fabrication technology which will overcome these fundamental limitations. The present invention fulfills this need, and further provides related advantages.

BRIEF SUMMARY OF THE INVENTION

The present invention provides a method for preparing an article made of an alloy of a metal such as titanium, aluminum, iron, nickel, cobalt, iron-nickel, iron-nickel-cobalt, and magnesium. The present approach circumvents problems which cannot be avoided in melting practice or are circumvented only with great difficulty and expense. The present approach permits a uniform alloy to be prepared without subjecting the constituents to the circumstance which leads to the problems, specifically the melting process. Unintentional oxidation of the reactive metal and the alloying elements is also avoided. The present approach permits the preparation of articles with compositions that may not be otherwise readily prepared in commercial quantities, including those having other additive constituents and, optionally, having thermophysically melt-incompatible alloying elements.

A method for preparing an article of a base metal alloyed with an alloying element comprises the step of preparing a precursor compound by the step of providing a chemically reducible nonmetallic base-metal precursor compound of a base metal. The method further includes thereafter chemically reducing the precursor compound to a metallic alloy, without melting the metallic alloy. The step of preparing or the step of chemically reducing includes the step of adding an other additive constituent. The metallic alloy is thereafter consolidated to produce a consolidated metallic article, without melting the metallic alloy and without melting the consolidated metallic article. The step of preparing may optionally include the additional steps of providing a chemically reducible nonmetallic alloying-element precursor compound of an alloying element, and thereafter mixing the base-metal precursor compound and the alloying-element precursor compound to form a compound mixture. There may be an additional step of reacting the other additive constituent.

The nonmetallic precursor compounds may be solid, liquid, or gaseous. The chemical reduction is preferably performed by solid-phase reduction, such as fused salt electrolysis of the precursor compounds in a finely divided solid form such as an oxide of the element; or by vapor-phase reduction, such as contacting vapor-phase halides of the base metal and the alloying element(s) with a liquid alkali metal or a liquid alkaline earth metal. The final article preferably has more titanium than any other element. The present approach is not limited to titanium-base alloys, however. Other alloys of current interest include aluminum-base alloys, iron-base alloys, nickel-base alloys, iron-nickel-base alloys, cobalt-base alloys, iron-nickel-cobalt-base alloys, and magnesium-base alloys, but the approach is operable with any alloys for which the nonmetallic precursor compounds are available that can be reduced to the metallic state.

The "other additive constituent" is defined as an element, mixture of elements, or compound that makes up a portion of the final alloy content and is introduced by a process different from the reduction process used to form the base metal. The other additive constituent may be dissolved into the matrix or may form discrete phases in the microstructure. The other additive constituent may be introduced by any operable approach, and four approaches are of particular interest. In a first approach, the step of preparing includes the step of furnishing the other additive constituent as an element or a compound and mixing the other additive constituent with the precursor compounds, and wherein the precursor compounds are reduced in the step of chemically reducing but the element or compound containing the other additive constituent is not reduced in the step of chemically reducing. In a second approach, the step of chemically reducing includes the step of mixing solid particles comprising the other additive constituent with the metallic alloy. In a third approach, the step of chemically reducing includes the step of depositing the other additive constituent from a gaseous phase on a surface of the metallic element or alloy, or on the surface of a precursor compound. In a fourth approach, the step of chemically reducing includes the step of depositing from a liquid phase the other additive constituent on a surface of the metallic element or alloy, or on the surface of a precursor compound. More than one other additive constituent may be introduced into the metal. One or more of the approaches for introducing other additive constituents may be used in combination. In some examples, the first approach may be practiced a single time to add one or more than one other additive constituent; or the first approach may be practiced more than one time to add more than one other additive constituent; or the first approach may be practiced to add one or more other additive constituents and the second approach may be practiced to add one or more other additive constituents.

The present approach for adding an other additive constituent is compatible with the addition of thermophysically melt incompatible alloying elements. In the alloys, there may be one or more thermophysically melt incompatible elements, and one or more elements that are not thermophysically melt incompatible with the base metal.

Thus, in another embodiment, a method for preparing an article made of a base metal (such as those discussed above) alloyed with an alloying element includes preparing a compound mixture by the steps of providing a chemically reducible nonmetallic base-metal precursor compound of the base metal, providing a chemically reducible nonmetallic alloying-element precursor compound of an alloying element (that optionally is thermophysically melt incompatible with the base metal), and thereafter mixing the base-metal precursor compound and the alloying-element precursor compound to form a compound mixture. The method further includes chemically reducing the compound mixture to produce a metallic alloy, without melting the metallic alloy. The step of preparing or the step of chemically reducing includes the step of adding an other additive constituent. The metallic alloy is thereafter consolidated to produce a consolidated metallic article, without melting the metallic alloy and without melting the consolidated metallic article. Other compatible features described herein may be used with this embodiment.

Some additional processing steps may be included in the present process. In some cases, it is preferred that the precursor compound mixture be compacted, after the step of mixing and before the step of chemical reduction. The result is a compacted mass which, when chemically reduced, produces a spongy metallic material. After the chemical reduction step, the metallic alloy is consolidated to produce a consolidated metallic article, without melting the metallic alloy and without melting the consolidated metallic article. This consolidation may be performed with any physical form of the metallic alloy produced by the chemical reduction, but the approach is particularly advantageously applied to consolidating of the pre-compacted sponge. Consolidation is preferably performed by hot pressing, hot isostatic pressing, or extrusion, but without melting in each case. Solid state diffusion of the alloying elements may also be used to achieve the consolidation.

The consolidated metallic article may be used in the as-consolidated form. In appropriate circumstances, it may be formed to other shapes using known forming techniques such as rolling, forging, extrusion, and the like. It may also be post-processed by known techniques such as machining, heat treating, surface coating, and the like.

The present approach is used to prepare articles from the precursor compounds, entirely without melting. As a result, the characteristics of any alloying elements which lead to problems during melting are avoided and cannot lead to inhomogeneities or irregularities in the final metallic alloy. The present approach thus produces the desired alloy composition of good quality, but without interference from melt-related problems that otherwise would prevent the formation of an acceptable alloy and microstructure.

The present approach differs from prior approaches in that the metal is not melted on a gross scale. Melting and its associated processing such as casting are expensive and also produce some undesirable microstructures that either are unavoidable or can be altered only with additional expensive processing modifications. The present approach reduces cost and avoids structures and irregularities associated with melting and casting, to improve mechanical properties of the final metallic article. It also results in some cases in an improved ability to fabricate specialized shapes and forms more readily, and to inspect those articles more readily. Additional benefits are realized in relation to particular metallic alloy systems, for example the reduction of the alpha case for susceptible titanium alloys.

The preferred form of the present approach also has the advantage of being based in a powder-form precursor. Starting with a powder of the nonmetallic precursor compounds avoids a cast structure with its associated irregularities such as elemental segregation on a nonequilibrium microscopic and macroscopic level, a cast microstructure with a range of grain sizes and morphologies that must be homogenized in some manner for many applications, gas entrapment, and contamination. The present approach produces a uniform, fine-grained, homogeneous, pore-free, gas-pore-free, and low-contamination final product.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

BRIEF DESCRIPTION OF THE DRAWINGS

FIG. 1 is a perspective view of a metallic article prepared according to the present approach;

FIG. 3 is a perspective view of a spongy mass of the initial metallic material.

DETAILED DESCRIPTION OF THE INVENTION

Figure 2:
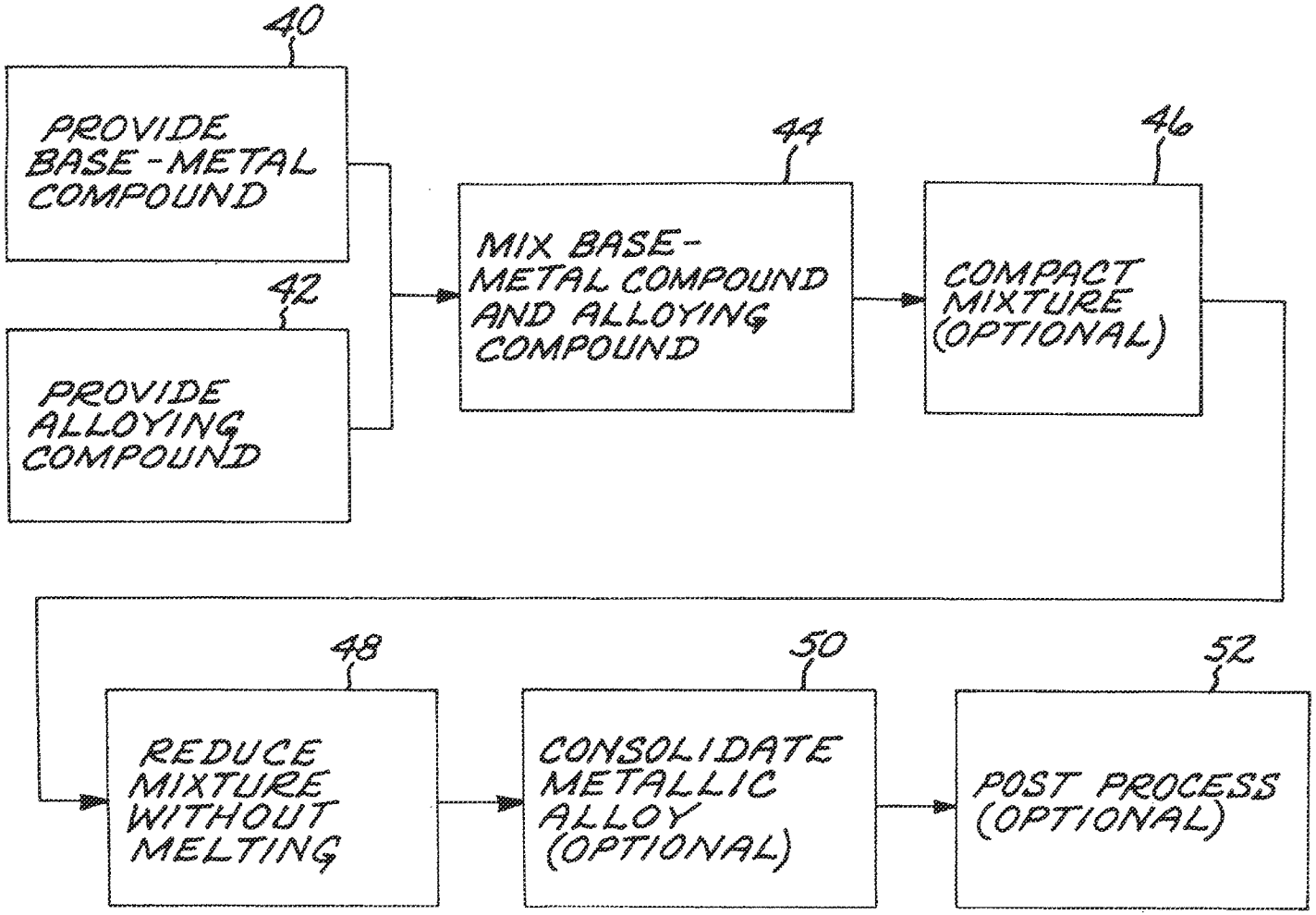
FIG. 2 is a block flow diagram of an approach for practicing the invention.

The present approach may be used to make a wide variety of metallic articles 20, such as a gas turbine compressor blade 22 of FIG. 1. The compressor blade 22 includes an airfoil 24, an attachment 26 that is used to attach the structure to a compressor disk (not shown), and a platform 28 between the airfoil 24 and the attachment 26. The compressor blade 22 is only one example of the types of articles 20 that may be fabricated by the present approach. Some other examples include other gas turbine parts such as fan blades, fan disks, compressor disks, turbine blades, turbine disks, bearings, blisks, cases, and shafts, automobile parts, biomedical articles, and structural members such as airframe parts. There is no known limitation on the types of articles that may be made by this approach.

FIG. 2 illustrates a preferred approach for preparing an article of a base metal and an alloying element. The method comprises providing a chemically reducible nonmetallic base-metal precursor compound, step 40, and providing a chemically reducible nonmetallic alloying-element precursor compound, step 42. "Nonmetallic precursor compounds" are nonmetallic compounds of the metals that eventually constitute the metallic article 20. Any operable nonmetallic precursor compounds may be used. Reducible oxides of the metals are the preferred nonmetallic precursor compounds in solid-phase reduction, but other types of nonmetallic compounds such as sulfides, carbides, halides, and nitrides are also operable. Reducible halides of the metals are the preferred nonmetallic precursor compounds in vapor-phase reduction. The base metal is a metal that is present in a greater percentage by weight than any other element in the alloy. The base-metal compound is present in an amount such that, after the chemical reduction to be described subsequently, there is more of the base metal present in the metallic alloy than any other element. In the preferred case, the base metal is titanium, and the base-metal compound is titanium oxide, $TiO_2$ (for solid-phase reduction) or titanium tetrachloride (for vapor-phase reduction). The alloying element may be any element that is available in the chemically reducible form of the precursor compound. A few illustrative examples are cadmium, zinc, silver, iron, cobalt, chromium, bismuth, copper, tungsten, tantalum, molybdenum, aluminum, niobium, nickel, manganese, magnesium, lithium, beryllium, and the rare earths.

The nonmetallic precursor compounds are selected to provide the necessary metals in the final metallic article, and are mixed together in the proper proportions to yield the necessary proportions of these metals in the metallic article. These precursor compounds are furnished and mixed together in the correct proportions such that the ratio of base metal and alloying additions in the mixture of precursor compounds is that required in the metallic alloy that forms the final article.

The base-metal compound and the alloying compound are finely divided solids or gaseous in form to ensure that they are chemically reacted in the subsequent step. The finely divided base-metal compound and alloying compound may be, for example, powders, granules, flakes, or the like. The preferred maximum dimension of the finely divided form is about 100 micrometers, although it is preferred that the maximum dimension be less than about 10 micrometers to ensure good reactivity.

The present approach may be utilized in conjunction with thermophysically melt incompatible alloys. "Thermophysical melt incompatibility" and related terms refer to the basic concept that any identified thermophysical property of an alloying element is sufficiently different from that of the base metal, in the preferred case titanium, to cause detrimental effects in the melted final product. These detrimental effects include phenomena such as chemical inhomogeneity (detrimental micro-segregation, macro-segregation such as beta flecks, and gross segregation from vaporization or immiscibility), inclusions of the alloying elements (such as high-density inclusions from elements such as tungsten, tantalum, molybdenum, and niobium), and the like. Thermophysical properties are intrinsic to the elements, and combinations of the elements which form alloys, and are typically envisioned using equilibrium phase diagrams, vapor pressure versus temperature curves, curves of densities as a function of crystal structure and temperature, and similar approaches. Although alloy systems may only approach predicted equilibrium, these envisioning data provide information sufficient to recognize and predict the cause of the detrimental effects as thermophysical melt incompatibilities. However, the ability to recognize and predict these detrimental effects as a result of the thermophysical melt incompatibility does not eliminate them. The present approach provides a technique to minimize and desirably avoid the detrimental effects by the elimination of melting in the preparation and processing of the alloy.

Thus, a thermophysical melt incompatible alloying element or elements in the alloy to be produced do not form a well mixed, homogeneous alloy with the base metal in a production melting operation in a stable, controllable fashion. In some instances, a thermophysically melt incompatible alloying element cannot be readily incorporated into the alloy at any compositional level, and in other instances the alloying element can be incorporated at low levels but not at higher levels. For example, iron does not behave in a thermophysically melt incompatible manner when introduced at low levels in titanium, typically up to about 0.3 weight percent, and homogeneous titanium-iron-containing alloys of low iron contents may be prepared. However, if iron is introduced at higher levels into titanium, it tends to segregate strongly in the melt and thus behaves in a thermophysically melt incompatible manner so that homogeneous alloys can only be prepared with great difficulty. In other examples, when magnesium is added to a titanium melt in vacuum, the magnesium immediately begins to vaporize due to its low vapor pressure, and therefore the melting cannot be accomplished in a stable manner. Tungsten tends to segregate in a titanium melt due to its density difference with titanium, making the formation of a homogeneous titanium-tungsten alloy extremely difficult.

The thermophysical melt incompatibility of the alloying element with a base metal may be any of several types. Because titanium is the preferred base metal, some illustrative examples for titanium are included in the following discussion.

One such thermophysical melt incompatibility is in the vapor pressure, as where the alloying element has an evaporation rate of greater than about 100 times that of titanium at a melt temperature, which is preferably a temperature just above the liquidus temperature of the alloy. Examples of such alloying elements in titanium include cadmium, zinc, bismuth, magnesium, and silver. Where the vapor pressure of the alloying element is too high, it will preferentially evaporate, as indicated by the evaporation rate values, when co-melted with titanium under a vacuum in conventional melting practice. An alloy will be formed, but it is not stable during melting and continuously loses the alloying element so that the percentage of the alloying element in the final alloy is difficult to control. In the present approach, because there is no vacuum melting, the high melt vapor pressure of the alloying element is not a concern.

Another such thermophysical melt incompatibility occurs when the melting point of the alloying element is too high or too low to be compatible with that of the base metal, as where the alloying element has a melting point different from (either greater than or less than) that of the base metal of more than about 400° C. (720° F.). Examples of such alloying elements in titanium include tungsten, tantalum, molybdenum, magnesium, and tin. If the melting point of the alloying element is too high, it is difficult to melt and homogenize the alloying element into the titanium melt in conventional vacuum melting practice. The segregation of such alloying elements may result in the formation of high-density inclusions containing that element, for example tungsten, tantalum, or molybdenum inclusions. If the melting point of the alloying element is too low, it will likely have an excessively high vapor pressure at the temperature required to melt the titanium. In the present approach, because there is no vacuum melting, the overly high or low melting points are not a concern.

Another such thermophysical melt incompatibility occurs when the density of the alloying element is so different from that of the base metal that the alloying element physically separates in the melt, as where the alloying element has a density difference with the base metal of greater than about 0.5 gram per cubic centimeter. Examples of such alloying elements in titanium include tungsten, tantalum, molybdenum, niobium, and aluminum. In conventional melting practice, the overly high or low density leads to gravity-driven segregation of the alloying element. In the present approach, because there is no melting there can be no gravity-driven segregation.

Another such thermophysical melt incompatibility occurs when the alloying element chemically reacts with the base metal in the liquid phase. Examples of such alloying elements in titanium include oxygen, nitrogen, silicon, boron, and beryllium. In conventional melting practice, the chemical reactivity of the alloying element with the base metal leads to the formation of intermetallic compounds including the base metal and the alloying element, and/or other deleterious phases in the melt, which are retained after the melt is solidified. These phases often have adverse effects on the properties of the final alloy. In the present approach, because the metals are not heated to the point where these reactions occur, the compounds are not formed.

Another such thermophysical melt incompatibility occurs when the alloying element exhibits a miscibility gap with the base metal in the liquid phase. Examples of such alloying elements in titanium include the rare earths such as cerium, gadolinium, lanthanum, and neodymium. In conventional melting practice, a miscibility gap leads to a segregation of the melt into the compositions defined by the miscibility gap. The result is inhomogeneities in the melt, which are retained in the final solidified article. The inhomogeneities lead to variations in properties throughout the final article. In the present approach, because the elements are not melted, the miscibility gap is not a concern.

Another, more complex thermophysical melt incompatibility involves the strong beta stabilizing elements that exhibit large liquidus-to-solidus gaps when alloyed with titanium. Some of these elements, such as iron, cobalt, and chromium, typically exhibit eutectic (or near-eutectic) phase reactions with titanium, and also usually exhibit a solid state-eutectoid decomposition of the beta phase into alpha phase plus a compound. Other such elements, such as bismuth and copper, typically exhibit peritectic phase reactions with titanium yielding beta phase from the liquid, and likewise usually exhibit a solid state eutectoid decomposition of the beta phase into alpha phase plus a compound. Such elements present extreme difficulties in achieving alloy homogeneity during solidification from the melt. This results not only because of normal solidification partitioning causing micro-segregation, but also because melt process perturbations are known to cause separation of the beta-stabilizing-element-rich liquid during solidification to cause macro-segregation regions typically called beta flecks.

Another thermophysical melt incompatibility is not strictly related to the nature of the base metal, but instead to the crucibles or environment in which the base metal is melted. Base metals may require the use of a particular crucible material or melting atmosphere, and some potential alloying elements may react with those crucible materials or melting atmospheres, and therefore not be candidates as alloying elements for that particular base metal.

Another thermophysical melt incompatibility involves elements such as the alkali metals and alkali-earth metals that have very limited solubility in base-metal alloys. Examples in titanium include lithium and calcium. Finely divided dispersions of these elements, for example beta calcium in alpha titanium, may not be readily achieved using a melt process.

These and other types of thermophysical melt incompatibilities lead to difficulty or impossibility in forming acceptable alloys of these elements in conventional production melting. Their adverse effects are avoided in the present melt-less approach.

The base-metal compound and the alloying compound are mixed to form a uniform, homogeneous compound mixture, step 44. The mixing is performed by conventional procedures used to mix powders in other applications, for solid-phase reduction, or by the mixing of the vapors, for vapor-phase reduction.

Optionally, for solid-phase reduction of solid precursor compound powders the compound mixture is compacted to make a preform, step 46. This compaction is conducted by cold or hot pressing of the finely divided compounds, but not at such a high temperature that there is any melting of the compounds. The compacted shape may be sintered in the solid state to temporarily bind the particles together. The compacting desirably forms a shape similar to, but larger in dimensions than, the shape of the final article, or intermediate product form.

The mixture of nonmetallic precursor compounds is thereafter chemically reduced by any operable technique to produce an initial metallic material, without melting the initial metallic material, step 48. As used herein, "without melting", "no melting", and related concepts mean that the material is not macroscopically or grossly melted, so that it liquefies and loses its shape. There may be, for example, some minor amount of localized melting as low-melting-point elements melt and are diffusionally alloyed with the higher-melting-point elements that do not melt. Even in such cases, the gross shape of the material remains unchanged.

In one approach, termed solid-phase reduction because the nonmetallic precursor compounds are furnished as solids, the chemical reduction may be performed by fused salt electrolysis. Fused salt electrolysis is a known technique that is described, for example, in published patent application WO 99/64638, whose disclosure is incorporated by reference in its entirety. Briefly, in fused salt electrolysis the mixture of nonmetallic precursor compounds is immersed in an electrolysis cell in a fused salt electrolyte such as a chloride salt at a temperature below the melting temperatures of the metals that form the nonmetallic precursor compounds. The mixture of nonmetallic precursor compounds is made the cathode of the electrolysis cell, with an anode. The elements combined with the metals in the nonmetallic precursor compounds, such as oxygen in the preferred case of oxide nonmetallic precursor compounds, are removed from the mixture by chemical reduction (i.e., the reverse of chemical oxidation). The reaction is performed at an elevated temperature to accelerate the diffusion of the oxygen or other gas away from the cathode. The cathodic potential is controlled to ensure that the reduction of the nonmetallic precursor compounds will occur, rather than other possible chemical reactions such as the decomposition of the molten salt. The electrolyte is a salt, preferably a salt that is more stable than the equivalent salt of the metals being refined and ideally very stable to remove the oxygen or other gas to a low level. The chlorides and mixtures of chlorides of barium, calcium, cesium, lithium, strontium, and yttrium are preferred. The chemical reduction may be carried to completion, so that the nonmetallic precursor compounds are completely reduced. The chemical reduction may instead be partial, such that some nonmetallic precursor compounds remain.

In another approach, termed vapor-phase reduction because the nonmetallic precursor compounds are furnished as vapors or gaseous phase, the chemical reduction may be performed by reducing mixtures of halides of the base metal and the alloying elements using a liquid alkali metal or a liquid alkaline earth metal. For example, titanium tetrachloride and the chlorides of the alloying elements are provided as gases. A mixture of these gases in appropriate amounts is contacted to molten sodium, so that the metallic halides are reduced to the metallic form. The metallic alloy is separated from the sodium. This reduction is performed at temperatures below the melting point of the metallic alloy. The approach is described more fully in U.S. Pat. Nos. 5,779,761 and 5,958,106, whose disclosures are incorporated by reference.

The physical form of the initial metallic material at the completion of step 48 depends upon the physical form of the mixture of nonmetallic precursor compounds at the beginning of step 48. If the mixture of nonmetallic precursor compounds is free-flowing, finely divided particles, powders, granules, pieces, or the like, the initial metallic material is also in the same form, except that it is smaller in size and typically somewhat porous. If the mixture of nonmetallic precursor compounds is a compressed mass of the finely divided particles, powders, granules, pieces, or the like, then the final physical form of the initial metallic material is typically in the form of a somewhat porous metallic sponge 60, as shown in FIG. 3. The external dimensions of the metallic sponge are smaller than those of the compressed mass of the nonmetallic precursor compound due to the removal of the oxygen and/or other combined elements in the reduction step 48. If the mixture of nonmetallic precursor compounds is a vapor, then the final physical form of the initial metallic material is typically fine powder that may be further processed.

Some constituents, termed "other additive constituents", may be difficult to introduce into the alloy. For example, suitable nonmetallic precursor compounds of the constituents may not be available, or the available nonmetallic precursor compounds of the other additive constituents may not be readily chemically reducible in a manner or at a temperature consistent with the chemical reduction of the other nonmetallic precursor compounds. It may be necessary that such other additive constituents ultimately be present as elements in solid solution in the alloy, as compounds formed by reaction with other constituents of the alloy, or as already-reacted, substantially inert compounds dispersed through the alloy. These other additive constituents or precursors thereof may be introduced from the gas, liquid, or solid phase, as may be appropriate, using one of the four approaches subsequently described or other operable approaches.

In a first approach, the other additive constituents are furnished as elements or compounds and are mixed with the precursor compounds prior to or concurrently with the step of chemically reducing. The mixture of precursor compounds and other additive constituents is subjected to the chemical reduction treatment of step 48, but only the precursor compounds are actually reduced and the other additive constituents are not reduced.

In a second approach, the other additive constituents in the form of solid particles are furnished but are not subjected to the chemical reduction treatment used for the base metal. Instead, they are mixed with the initial metallic material that results from the chemical reduction step, but after the step of chemically reducing 48 is complete. This approach is particularly effective when the step of chemically reducing is performed on a flowing powder of the precursor compounds, but it also may be performed using a pre-compacted mass of the precursor compounds, resulting in a spongy mass of the initial metallic material. The other additive constituents are adhered to the surface of the powder or to the surface of, and into the porosity of, the spongy mass. Solid particles may be optionally reacted in one or more steps if they are precursors to the other additive constituent.

In a third approach, the precursor is first produced as powder particles, or as a sponge by compacting the precursor compounds of the metallic elements. The particles are, or the sponge is, then chemically reduced. The other additive constituent is thereafter produced at the surfaces (external and internal, if the particles are spongelike) of the particles, or at the external and internal surfaces of the sponge, from the gaseous phase. In one technique, a gaseous precursor or elemental form (e.g., methane, nitrogen, or borane gas) is flowed over the surface of the particle or sponge to deposit the compound or element onto the surface from the gas. The material produced at the surfaces may be optionally reacted in one or more steps if they are precursors to the other additive constituent. In an example, boron is supplied to a titanium surface by flowing borane over the surface, and in subsequent processing the deposited boron is reacted to form titanium diboride. The gas carrying the constituent of interest may be supplied in any operable manner, such as from a commercially available gas or by generating the gas such as by the electron beam vaporization of a ceramic or metal, or using a plasma.

A fourth approach is similar to the third approach, except that the other additive constituent is deposited from a liquid rather than from a gas. The precursor is first produced as powder particles, or as a sponge by compacting the precursor compounds of the metallic elements. The particles are, or the sponge is, then chemically reduced. The other additive constituent is thereafter produced at the surfaces (external and internal, if the particles are spongelike) of the particles, or at the external and internal surfaces of the sponge, by deposition from the liquid. In one technique, the particulate or sponge is dipped into a liquid solution of a precursor compound of the other additive constituent to coat the surfaces of the particles or the sponge. The precursor compound of the other additive constituent is second chemically reacted to leave the other additive constituent at the surfaces of the particles or at the surfaces of the sponge. In an example, lanthanum may be introduced into a titanium-base alloy by coating the surfaces of the reduced particles or sponge (produced from the precursor compounds) with lanthanum chloride. The coated particles are, or the sponge is, thereafter heated and/or exposed to vacuum to drive off the chlorine, leaving lanthanum at the surfaces of the particles or sponge. Optionally, the lanthanum-coated particles or sponge may be oxidized to form a fine lanthanum-oxygen dispersion, using oxygen from the environment or from solution in the metal, or the lanthanum-coated particles or sponge may be reacted with another element such as sulfur. In another approach, the constituent is electrochemically plated onto the particles or the sponge. In yet another approach, the particles or sponge may be dipped into a bath containing the other additive constituent, removed from the bath, and any solvent or carrier evaporated to leave a coating on the surface of the particle or sponge.

Whatever the reduction technique used in step 48 and however the other additive constituent is introduced, the result is a mixture that comprises the alloy composition. Methods for introducing other additive constituents may be performed on precursors prior to the reduction of the base-metal constituent, or on already-reduced material. The metallic alloy may be free-flowing particles in some circumstances, or have a sponge-like structure in other cases. The sponge-like structure is produced in the solid-phase reduction approach if the precursor compounds have first been compacted together prior to the commencement of the actual chemical reduction. The precursor compounds may be compressed to form a compressed mass that is larger in dimensions than a desired final metallic article.

The chemical composition of the initial metallic alloy is determined by the types and amounts of the metals in the mixture of nonmetallic precursor compounds furnished in steps 40 and 42, and by the other additive constituents that are introduced in the processing. The relative proportions of the metallic elements are determined by their respective ratios in the mixture of step 44 (not by the respective ratios of the compounds, but the respective ratios of the metallic element). In a case of most interest, the initial metallic alloy has more titanium than any other element as the base metal, producing a titanium-base initial metallic alloy. Other base metals of interest include aluminum, iron, nickel, cobalt, iron-nickel, iron-nickel-cobalt, and magnesium.

The initial metallic alloy is typically in a form that is not structurally useful for most applications. Accordingly and preferably, the initial metallic alloy is thereafter consolidated to produce a consolidated metallic article, without melting the initial metallic alloy and without melting the consolidated metallic article, step 50. The consolidation removes porosity from the initial metallic alloy, desirably increasing its relative density to or near 100 percent. Any operable type of consolidation may be used. It is preferred that the consolidation be performed without a binder, which is an organic or inorganic material mixed with the powder to aid in adhering the powder particles to each other during the consolidation processing. The binder may leave an undesirable residue in the final structure, and its use is therefore preferably avoided.

Preferably, the consolidation 50 is performed by hot isostatic pressing the initial metallic alloy under appropriate conditions of temperature and pressure, but at a temperature less than the melting points of the initial metallic alloy and the consolidated metallic article (which melting points are typically the same or very close together). Pressing, solid-state sintering, and canned extrusion may also be used, particularly where the initial metallic alloy is in the form of a powder. The consolidation reduces the external dimensions of the mass of initial metallic alloy, but such reduction in dimensions are predictable with experience for particular compositions. The consolidation processing 50 may also be used to achieve further alloying of the metallic article. For example, the can used in hot isostatic pressing may not be evacuated so that there is a residual oxygen and nitrogen content, or a carbon-containing gas could be introduced into the can. Upon heating for the hot isostatic pressing, the residual oxygen, nitrogen, and/or carbon diffuses into and alloys with the titanium-base alloy.

The consolidated metallic article, such as that shown in FIG. 1, may be used in its as-consolidated form. Instead, in appropriate cases the consolidated metallic article may optionally be post processed, step 52. The post processing may include forming by any operable metallic forming process, as by forging, extrusion, rolling, and the like. Some metallic compositions are amenable to such forming operations, and others are not. The consolidated metallic article may also or instead be optionally post-processed by other conventional metal processing techniques in step 52. Such post-processing may include, for example, heat treating, surface coating, machining, and the like.

The metallic material is never heated above its melting point. Additionally, it may be maintained below specific temperatures that are themselves below the melting point. For example, when an alpha-beta titanium-base alloy is heated above the beta transus temperature, beta phase is formed. he beta phase transforms to alpha phase when the alloy is cooled below the beta transus temperature. For some applications, it is desirable that the metallic alloy not be heated to a temperature above the beta transus temperature. In this case care is taken that the alloy sponge or other metallic form is not heated above its beta transus temperature at any point during the processing. The result is a fine microstructure that is free of alpha-phase colonies and may be made superplastic more readily than a coarse microstructure. Because of the fine particle size resulting from this processing, less work is required to reach a fine structure in the final article, leading to a lower-cost product. Subsequent manufacturing operations are simplified because of the lower flow stress of the material, so that smaller, lower-cost forging presses and other metalworking machinery may be employed, and their is less wear on the machinery.

In other cases such as some airframe components and structures, it is desirable to heat the alloy above the beta transus and into the beta phase range, so that beta phase is produced and the toughness of the final product is improved. In this case, the metallic alloy may be heated to temperatures above the beta transus temperature during the processing, but in any case not above the melting point of the alloy. When the article heated above the beta transus temperature is cooled again to temperatures below the beta transus temperature, a fine colony structure is formed that can make ultrasonic inspection of the article more difficult. In that case, it may be desirable for the article to be fabricated and ultrasonically inspected at low temperatures, without having been heated to temperatures above the beta transus temperature, so that it is in a colony free state. After completion of the ultrasonic inspection to verify that the article is irregularity-free, it may then be heat treated at a temperature above the beta transus temperature and cooled. The final article is less inspectable than the article which has not been heated above the beta transus, but the absence of irregularities has already been established.

The microstructural type, morphology, and scale of the article is determined by the starting materials and the processing. The grains of the articles produced by the present approach generally correspond to the morphology and size of the powder particles of the starting materials, when the solid-phase reduction technique is used. Thus, a 5-micrometer precursor particle size produces a final grain size on the order of about 5 micrometers. It is preferred for most applications that the grain size be less than about 10 micrometers, although the grain size may be as high as 100 micrometers or larger. As discussed earlier, the present approach applied to titanium-base alloys avoids a coarse alpha-colony structure resulting from transformed coarse beta grains, which, in conventional melt-based processing, is produced when the melt cools into the beta region of the phase diagram. In the present approach, the metal is never melted and cooled from the melt into the beta region, so that the coarse beta grains never occur. Beta grains may be produced during subsequent processing as described above, but they are produced at lower temperatures than the melting point and are therefore much finer than are beta grains resulting from cooling from the melt in conventional practice. In conventional melt-based practice, subsequent metalworking processes are designed to break up and globularize the coarse alpha structure associated with the colony structure. Such processing is not required in the present approach because the structure as produced is fine and does not comprise alpha plates.

The present approach processes the mixture of nonmetallic precursor compounds to a finished metallic form without the metal of the finished metallic form ever being heated above its melting point. Consequently, the process avoids the costs associated with melting operations, such as controlled-atmosphere or vacuum furnace costs in the case of titanium-base alloys. The microstructures associated with melting, typically large-grained structures and casting irregularities, are not found. Without such irregularities, the articles may be made lighter in weight because extra material introduced to compensate for the irregularities may be eliminated. The greater confidence in the irregularity-free state of the article, achieved with the better inspectability discussed above, also leads to a reduction in the extra material that must otherwise be present. In the case of susceptible titanium-base alloys, the incidence of alpha case formation is also reduced or avoided, because of the reducing environment. Mechanical properties such as static strength and fatigue strength are improved.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method for preparing an article of a base metal alloyed with an alloying element, comprising the steps of preparing a precursor compound by the step of providing a chemically reducible nonmetallic base-metal precursor compound of a base metal;

providing a chemically reducible nonmetallic alloying-element precursor compound of an alloying element, and thereafter mixing the base-metal precursor compound and the alloying-element precursor compound to form a compound mixture; thereafter chemically reducing the precursor compound to form a metallic alloy, without melting the metallic alloy;

adding a precursor of an other additive constituent; thereafter reacting the precursor of the other additive constituent to deposit the other additive constituent on the metallic alloy; and thereafter consolidating the metallic alloy to produce a consolidated metallic article, without melting the metallic alloy and without melting the consolidated metallic article, where in the step of adding the precursor of the other additive constituent includes a step selected from the group consisting of mixing a solid phase precursor of the other additive constituent with the metallic alloy, depositing from a gaseous phase the precursor of the other additive constituent on a surface of the metallic alloy, and depositing from a liquid phase the precursor of the other additive constituent on a surface of the metallic alloy, where in the other additive constituent is an element, mixture of elements, or compound that makes up a portion of the consolidated metallic article and is introduced by a process different from the reduction process used to form the base metal.

2. The method of claim 1, wherein the step of providing a chemically reducible nonmetallic base-metal precursor compound of a base metal includes the step of selecting the base metal as titanium, aluminum, iron, nickel, cobalt, iron-nickel, iron-nickel-cobalt, or magnesium.

3. The method of claim 1, wherein the step of providing a chemically reducible nonmetallic base-metal precursor compound of a base metal includes the step of selecting the base metal as titanium.

4. The method of claim 1, wherein the step of providing a chemically reducible nonmetallic base-metal precursor compound includes the step of providing a chemically reducible base-metal oxide.

5. The method of claim 1, wherein the step of providing the chemically reducible nonmetallic alloying-element precursor compound of the alloying element includes the step of providing a chemically reducible alloying-element oxide.

6. The method of claim 1, wherein the step of chemically reducing includes a step selected from the group consisting of:

chemically reducing the compound mixture by solid-phase reduction, chemically reducing the compound mixture by fused salt electrolysis, and chemically reducing the compound mixture by vapor-phase reduction.

7. The method of claim 1, wherein the step of chemically reducing to form a metallic alloy comprises forming metallic alloy particles.

8. A method for preparing an article of a base metal alloyed with an alloying element, comprising the steps of preparing a precursor compound by the step of providing a chemically reducible nonmetallic base-metal precursor compound of a base metal;

providing a chemically reducible nonmetallic alloying-element precursor compound of an alloying element, and thereafter mixing the base-metal precursor compound and the alloying-element precursor compound to form a compound mixture; thereafter chemically reducing the precursor compound to form a metallic alloy, without melting the metallic alloy, consolidating the metallic alloy to produce a consolidated metallic article, without melting the metallic alloy and without melting the consolidated metallic article, where in an other additive constituent is added during the step of chemically reducing and wherein the other additive constituent is an element, mixture of elements, or compound that makes up a portion of the final alloy content of the metallic alloy that is not itself reduced during the step of chemically reducing the precursor compound.

9. The method of claim 8, wherein the step of providing a chemically reducible nonmetallic base-metal precursor compound of a base metal includes the step of selecting the base metal as titanium, aluminum, iron, nickel, cobalt, iron-nickel, iron-nickel-cobalt, or magnesium.

10. The method of claim 8, wherein the step of providing a chemically reducible nonmetallic base-metal precursor compound of a base metal includes the step of selecting the base metal as titanium.

11. The method of claim 8, wherein the step of providing a chemically reducible nonmetallic base-metal precursor compound includes the step of providing a chemically reducible base-metal oxide.

12. The method of claim 8, wherein the step of providing the chemically reducible nonmetallic alloying-element precursor compound of the alloying element includes the step of providing a chemically reducible alloying-element oxide.

13. A method for preparing an article of a base metal alloyed with an alloying element, comprising the steps of preparing a precursor compound by the step of providing a chemically reducible nonmetallic base-metal precursor compound of a base metal;

providing a chemically reducible nonmetallic alloying-element precursor compound of an alloying element, and thereafter mixing the base-metal precursor compound and the alloying-element precursor compound to form a compound mixture; thereafter chemically reducing the precursor compound by solid-phase reduction to form a metallic alloy, without melting the metallic alloy, wherein the step of chemically reducing includes the step of adding an other additive constituent; and thereafter consolidating the metallic alloy to produce a consolidated metallic article, without melting the metallic alloy and without melting the consolidated metallic article, and where in the step of chemically reducing includes a step selected from the group consisting of mixing solid particles comprising the other additive constituent with the metallic alloy, depositing from a gaseous phase the other additive constituent on a surface of the metallic alloy, and depositing from a liquid phase the other additive constituent on a surface of the metallic alloy.

14. The method of claim 13, wherein the step of providing a chemically reducible nonmetallic base-metal precursor compound of a base metal includes the step of selecting the base metal as titanium, aluminum, iron, nickel, cobalt, iron-nickel, iron-nickel-cobalt, or magnesium.

15. The method of claim 13, wherein the step of providing a chemically reducible nonmetallic base-metal precursor compound of a base metal includes the step of selecting the base metal as titanium.

16. A method for preparing an article of a base metal alloyed with an alloying element, comprising the steps of preparing a precursor compound by the step of providing a chemically reducible nonmetallic base-metal precursor compound of a base metal;

providing a chemically reducible nonmetallic alloying-element precursor compound of an alloying element, and thereafter mixing the base-metal precursor compound and the alloying-element precursor compound to form a compound mixture; thereafter chemically reducing the precursor compound by vapor phase reduction to form a metallic alloy, without melting the metallic alloy, wherein the step of chemically reducing includes the step of adding an other additive constituent; and thereafter consolidating the metallic alloy to produce a consolidated metallic article, without melting the metallic alloy and without melting the consolidated metallic article, and where in the step of chemically reducing includes a step selected from the group consisting of mixing solid particles comprising the other additive constituent with the metallic alloy, depositing from a gaseous phase the other additive constituent on a surface of the metallic alloy, and depositing from a liquid phase the other additive constituent on a surface of the metallic alloy.

17. The method of claim 16, wherein the step of providing a chemically reducible nonmetallic base-metal precursor compound of a base metal includes the step of selecting the base metal as titanium, aluminum, iron, nickel, cobalt, iron-nickel, iron-nickel-cobalt, or magnesium.

18. The method of claim 16, wherein the step of providing a chemically reducible nonmetallic base-metal precursor compound of a base metal includes the step of selecting the base metal as titanium.

19. The method of claim 16, wherein the step of providing the chemically reducible nonmetallic alloying-element precursor compound of the alloying element includes the step of providing a chemically reducible alloying-element halide.

* * * * *